United States Patent [19]

Gerhard

[11] 4,356,925

[45] Nov. 2, 1982

[54] PRESSURE-RESISTANT CONTAINER FOR LIQUIDS, GASES OR LOOSE MATERIAL COMPOSED OF TWO OR MORE SHELLS

[75] Inventor: Helmut Gerhard, Weitefeld, Fed. Rep. of Germany

[73] Assignee: Westerwalder Eisenwerk Gerhard GmbH, Fed. Rep. of Germany

[21] Appl. No.: 217,223

[22] Filed: Dec. 17, 1980

[30] Foreign Application Priority Data

Dec. 21, 1979 [DE] Fed. Rep. of Germany ..... 2951554

[51] Int. Cl.[3] ..... B65D 87/00; B65J 1/02

[52] U.S. Cl. ..... 220/1.5; 220/1 B; 220/3; 220/5 A; 220/401

[58] Field of Search ..... 220/1 B, 1.5, 3, 71, 220/401, 5 A

[56] References Cited

U.S. PATENT DOCUMENTS 3,799,383 3/1974 Gerhard ..... 220/1.5
3,814,290 6/1974 Gerhard ..... 220/1.5 X
3,912,103 10/1975 Gerhard ..... 220/5 A X
4,098,426 7/1978 Gerhard ..... 220/83 X
4,307,812 12/1981 Gerhard ..... 220/5 A X

FOREIGN PATENT DOCUMENTS 716398 8/1965 Canada ..... 220/1 B
2209484 9/1973 Fed. Rep. of Germany ..... 220/1.5

*Primary Examiner*—William Price
*Assistant Examiner*—Gary E. Elkins
*Attorney, Agent, or Firm*—Antonelli, Terry & Wands

[57] ABSTRACT

A pressure-resistant container for liquids, gases, or loose material is composed of at least two part-cylindrical shells which have mutually parallel axes and intersect each other so as to form troughs between the tops and bottom thereof, respectively. In accordance with a preferred embodiment, the ends of the part-cylindrical shells are joined at their edges along the height of the longitudinal troughs formed between the tops and bottoms of the part-cylindrical shells of the container by their intersection, whereby a central shell element forms tunnels respectively interconnecting the tops and bottoms of the part-cylindrical shells.

10 Claims, 5 Drawing Figures

Figure 1:
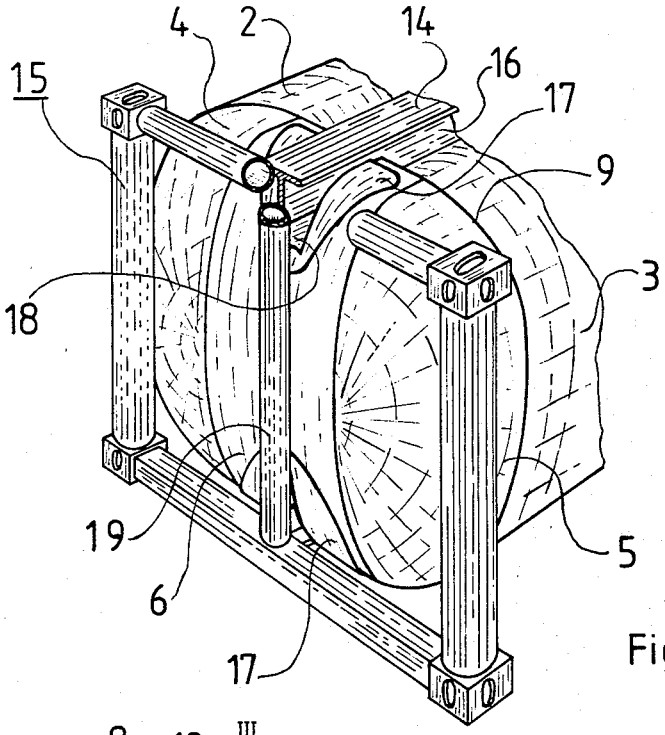

PRESSURE-RESISTANT CONTAINER FOR LIQUIDS, GASES OR LOOSE MATERIAL COMPOSED OF TWO OR MORE SHELLS

The invention relates to a pressure-resistant container for liquids, gases or loose material composed of two or more shells and having an outer wall which is formed by two or more intersecting part-cylindrical shells having mutually parallel axes, and end walls each formed by two halves of a cap-shaped member and a central shell closing an opening between straight section edges of the halves of the cap-shaped member.

Formation of the end wall of containers formed of two or more lying cylindrical shells, has been for a long time the subject of constant further development.

For instance the end wall of a container composed of two intersecting part-cylindrical shells was made of two halves of a cap-shaped member and the space between the straight section edges of the bottom halves was bridged by a reinforced connection piece. As one such connecting piece; and a U-section, the arms of which were along the curvature of the adjacent section edges of the bottom halves was utilized welded to said edges. Also used as such a connecting piece is a cylindrically curved connection piece, the curvature of which is adjusted to a part of the curvature of the cap-shaped halves at the section edges. These connection pieces have, at their top and bottom rim, box pieces which bridge the transition from the main curved area of one cap-shaped member half, via the border region to the cylindrical border of the adjacent cap-shaped member half.

Due to the numerous welds which are needed for this purpose in the end regions, these known formations of the end walls require too much work, and due to the enormous heat to which they are exposed due to the welding, prestressing takes place which makes them susceptible to cracking.

The aim of the invention is to devise a simpler pressure-resistant container end wall, the bottom region of which may be used as a channel for emptying, and the top region of which may be used as a tunnel for air equalization of the container.

This is achieved according to the invention in that the connecting pieces for cap-shaped member halves is formed by part-cylindrical central shell elements which are curved about horizontal transverse axes, and have radii of curvature corresponding to the radii of curvature of the adjacent cap-shaped member halves, a plane adjacent the border thereof following cylindrical borders of the cap-shaped member halves and extending into an end surface joined vertically at its edge, the height of which is given at least by the distance between the tops or bottoms of the cylindrical shells of the container and longitudinal troughs formed by their intersection.

Due to the formation of the central shell elements according to the invention, their large central radius of curvature corresponds to the radius of curvature of the adjacent cap-shaped member halves. Particularly, the central shell elements also follow their curvature in the corner regions, the radius of curvature of the cap-shaped members merging in the upper and bottom smaller corner radii of the borders and in continuation thereof in the cylindrical borders of the bottom halves, and end there at the top and bottom in an end surface joined at the edge at right angles.

In this formation, the number of welds needed for the connection of the central shell elements to the container parts and the cap-shaped member halves and also their length are reduced to a minimum. Particularly, in the region of the end walls, only parts which are curved in the same way are connected to each other, which practically avoid stresses between the parts being connected, as is the case in known solutions. The end region of the container shells, which is not covered by the halves of the cap-shaped members, (i.e. the receding portions between the cylindrical shells of the tank body which intersect each other) is in butt connection with the, formed-on, vertical end surfaces of the central shell elements, and may be connected to them by simple fillet welds.

As, according to a further feature of the invention, the height of the vertical end surfaces corresponds at least to the distance between the tops or bottoms of the container shells and the trough formed by their intersection, they form, together with the central shell elements transverse connections in the form of troughs or tunnels from top to top or bottom to bottom so that they may serve as a connection tunnel for the gases present above the surface of the liquid in the container and to make evacuation easier, and as a communication channel between the bottoms of the container for complete emptying of the container.

These functions can be obtained in known container forms, even containers composed of several shells, only by additional work intensive welding-in of ducts or troughs, which must be welded into specially made cutouts in the container shells.

Welding in of such tunnel or duct elements requires however not only additional use of material and cutting out of the container wall and additional work for the making of the ducts and their welding-in, but also supply of welding heat which considerably reduces the strength and fatigue safety of the container, and thereby causes contraction strain which may lead to stress corrosion and fatigue.

It is customary to situate in the troughs formed by the intersection of the horizontal cylindrical shells of the container, longitudinal beams for taking up inner pressure, which may end at their ends in a transverse beam of the end frame. These longitudinal beams are formed as T-section carriers or channel or angle sections, depending on the number of container shells intersecting each other.

According to a further development of the invention, the longitudinal beams may end at the end surfaces joined at the edge of the central shell elements and be connected there by an inner tie member, or they may, for their stabilization, extend beyond the end wall of the container and be connected to a transverse beam of the end frame and/or to a tie element in the end region. It is advantageous when the longitudinal beams are notched in the region of the end surface joined at the edge of the cylindrical border and extend beyond the border region and follow the outline of the central shell at least until they re-assume the original height of the longitudinal beam.

According to a further preferred embodiment of the invention, a suitably shaped pressure sheet is welded in the notched region of the longitudinal beams between the central shell elements and the longitudinal beam to ensure a better distribution of the surface pressure on to the central shell elements. The longitudinal beams are thereby, at the same time, reinforced in the notched region.

Details of the invention are apparent from the following description, by way of example, of embodiments with reference to the drawings.

Figure 2:
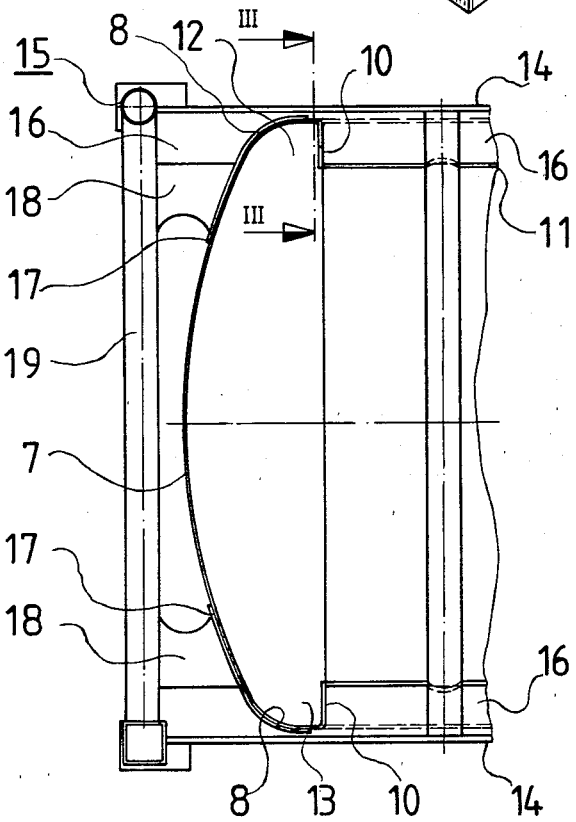
Figure 3:
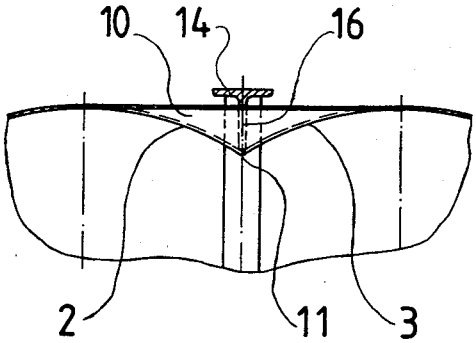
Figure 4:
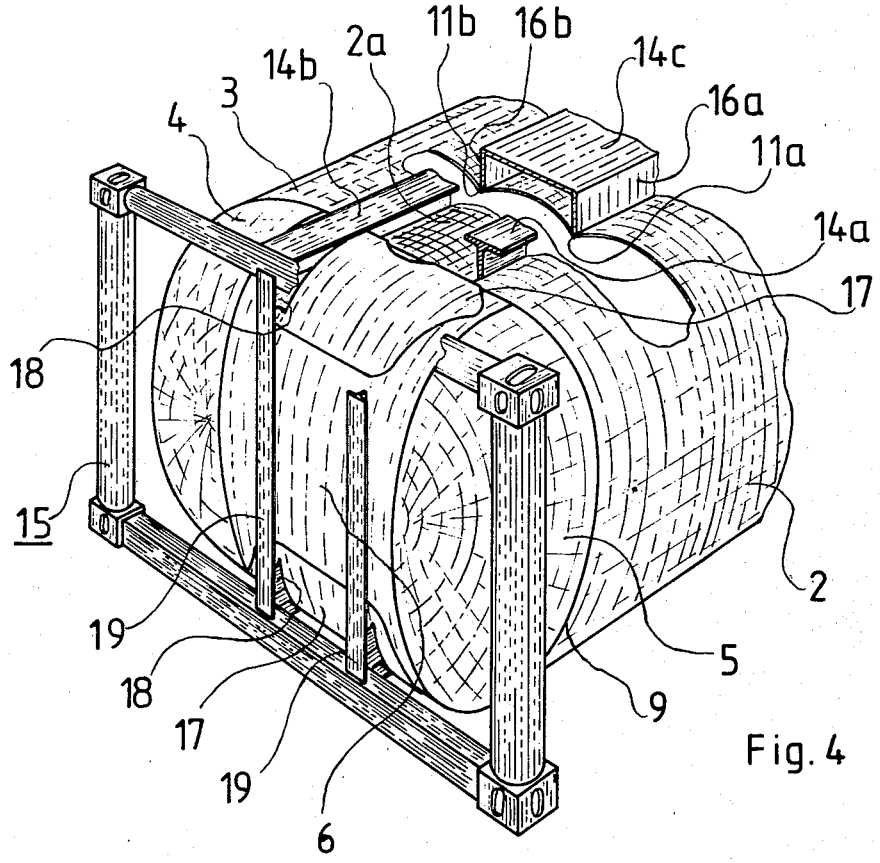
Figure 5:
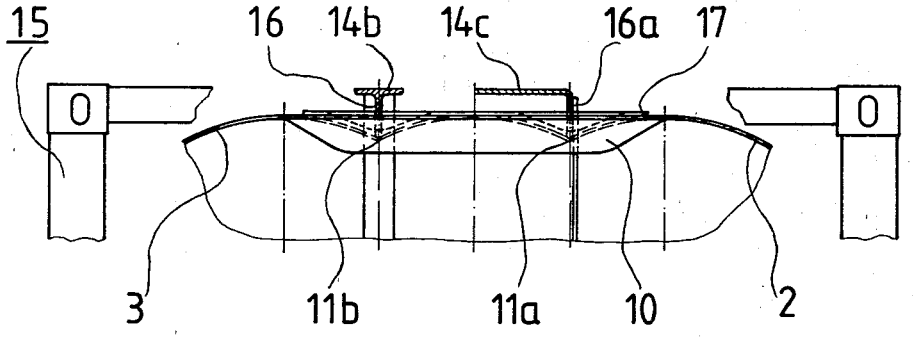

In the drawings:

FIG. 1 is a partial perspective illustration of a container in accordance with the present invention; composed of two shells illustrating the formation of an end wall thereof;

FIG. 2 is a vertical section through the longitudinal axis of the part of the container shown in FIG. 1, FIG. 3 is a detail of a cross section through the container along line III—III in FIG. 2, FIG. 4 is a partial perspective illustration a container in accordance with the present invention; composed of three shells and having a U-shaped central longitudinal beam illustrating the formation of an end wall thereof; and FIG. 5 is a partial cross-sectional view of a container end wall of the FIG. 4 container.

The container shown in FIG. 1 is composed of two part-cylindrical shells 2, 3 that intersect each other and having mutually parallel longitudinal axes and are closed at each of the ends by an end wall formed of two halves 4, 5 of a cap-shaped member and a central shell element 6 that is centrally interconnected between the two halves 4, 5.

As is apparent from FIG. 2, the central shell element 6 is curved according to the outline of the cap-shaped member. Its central radius of curvature corresponds, therefore, to the large radius 7 of the curvature of the halves 4,5 of the cap-shaped members. Also, above and below this large radius of curvature 7, the central shell element 6 matches the corner radii of the halves 4, 5, which are more sharply curved in the border region 8, and then follows the adjacent straight of the cylindrical border of the halves 4, 5 approximately up to the plane of the round weld 9 between the halves 4, 5 and the cylindrical shells 2, 3.

The central shell element 6 is extended at the top and bottom in the plane of the round weld 9 by a further piece 10, which extends at right angles to the container axis from the top downwardly and from the bottom upwardly and ends at the top below and at the bottom above, the troughs 11 formed between the cylindrical shells 2, 3 in the area of their intersection, and will therefore, in the following, be referred to as end surface 10. The end surfaces 10 close the receding portions between the cylindrical shells 2, 3 of the container in the area where they intersect each other and the central shell element in the manner of gussets.

By forming of these vertical end surfaces 10 on the central shell elements, without additional welding, a tunnel 12 is formed connecting the tops of the two part-cylinders 2, 3 of part-circular cross-section by means of which may be equalized the gases formed above the surface of the liquid.

Substantially the same applies to the lower region where channel 13, open to the inside of the container, is formed between the two cylindrical bottoms, to enable complete emptying of the container without the use of additional emptying ducts.

The vertical end surfaces 10 of the central shell element 6, which extend to the inside of the container, serve in addition as non-positive closure surfaces for the bottom region of the central longitudinal beams 14 positioned in the longitudinal troughs 11 at the top and bottom to take up tensile forces. These central longitudinal beams 14 are made in the two-shell container illustrated in FIGS. 1 to 3, as T-sections. The central longitudinal beams 14 may end for instance at the end surfaces 10 of the central shells 6 and be there connected by means of an inner tie element. This is not illustrated.

In order to stabilize the border region 8 which has the tendency to buckle, central longitudinal beams 14 are provided, according to the embodiment illustrated in FIGS. 1 to 3, which extend beyond the length of the part-cylindrical shells 2, 3 and the sharply curved border region up to an end frame 15 which is situated beyond the end of the container 1. The web 16 of the central longitudinal beam 14 is for this purpose provided with a notch of a shape corresponding to the curvature of the central shell element 6 in the border region 8 and the extension of the end surfaces 10 adjacent thereto so that the notch and follows their outer outline, at the top downwardly and at the bottom upwardly, until the beam re-assumes its original height. This web 16 then extends with unchanged cross-section up to the upper or, respectively lower, transverse support beam of the end frame 15.

Between the notched edge of the web 16 in the central longitudinal beam 14 and the central shell element 6 is welded a pressure sheet 17 shaped according to the outline of the central shell. By means of this pressure sheet 17, the surface pressure acting on the central shell element 6 is better distributed, and on the other hand, a certain reinforcement is provided for the extended central longitudinal beam 14 in the notched region in the manner of a double T-section.

In order to prevent wedging of the extended central longitudinal beams 14, a tie section 19 is provided, in the plane of the end frame 15 and outside of the central shell element 6, which connects the upper and lower transverse carrier beams of the end frame 15 and on which end the central longitudinal beams 14.

Bulging of the central shell element 6 in the region of its sharply curved corner radii is additionally limited by a gusset 18 which is arranged below the vertical web 16 of the central longitudinal beams 14 and inwardly of tie section 19. The lower end of the gusset 18 is recessed, at an end facing away from web 16, to have a curved outline so as to avoid fatigue cracks. The gussets 18 are connected to the tie profiles 19 and pressure sheet 17.

FIGS. 4 and 5 show a container composed of three shells. Parts which correspond to FIGS. 1 to 3 have the same references. It must, however, be pointed out that the central shell element 6 situated between the two bottom halves 4, 5 limits at the end also the central part-cylinder **2*a*, and the end surface 10 formed thereon closes the receding portions formed by the two troughs 11*a* and 11*b* (FIG. 5**).

Instead of a central longitudinal beam 14 in the form of a T-section or angle section, either two mutually parallel central longitudinal beams **14*a, b* in the form of a T-section or angle section are provided or a longitudinal beam in the form of a channel section 14*c*, the arms 16*a, b* of which extend in the parallel troughs 11*a* and 11*b* are used according to FIG. 4**.

Means used according to FIGS. 1 to 3 for reinforcement of the central shell element 6 may be analogically applied to the two parallel central longitudinal beams **14*a, b* or the central longitudinal beam in the form of a channel section 14*c***.

I claim:

1. A pressure-resistant container for liquids, gases or loose material composed of at least two part-cylindrical shells which have mutually parallel axes and intersect each other so as to form troughs between the tops and bottoms thereof, respectively, and end walls, each of which is formed by two halves of a cap-shaped member and a central shell element interconnected between section edges of said halves in a manner closing an opening between the section edges of the halves, wherein each central shell element is curved about a horizontal transverse axis, the radii of the curvature of the central shell element corresponding to that of the section edges of the halves of the cap-shaped member between which it is interconnected, and is provided, at opposite ends thereof, with vertical end surface portions which are, at ends of the part-cylindrical shells, joined at their edges along the height of the longitudinal troughs formed between the tops and bottoms of the part-cylindrical shells of the container by their intersection, whereby said central shell element forms tunnels respectively interconnecting the tops and bottoms of said part-cylindrical shells.

2. A container according to claim 1, having lontigudinal beams extending in said longitudinal troughs, wherein the longitudinal beams end at said end surface portions and are connected thereat to an inner tie element.

3. A container according to claim 1, having longitudinal beams extending in said longitudinal troughs, wherein vertical webs of the longitudinal beams are notched so as to overlie the end walls in the regions of the end surface portions and follow the outline of the central shell elements at least until the beams re-assume their original height.

4. A container according to claim 3, wherein the longitudinal beams, in order to stabilize the central shell element, extend beyond the end wall of the container and are connected to a tie element at respective supporting end frames.

5. A container according to claim 3 or 4, wherein, in the notched region of the longitudinal beams, between the central shell element and the longitudinal beam, is welded a pressure sheet for better distribution of surface pressure on to the central shell elements and for the reinforcement of the longitudinal beams in the notched region.

6. A container according to claim 5, wherein the longitudinal beams are connected at their ends to at least one of upper and lower transverse beams of an end frame of the container.

7. A container according to claim 2 or 3, wherein the longitudinal beam has a T-section.

8. A container according to claim 5, wherein each pressure sheet acts in conjunction with the longitudinal beams in the manner of a double T-section.

9. A container according to claim 2 or 3, wherein the container is composed of at least three intersecting part-cylindrical shells, said longitudinal beams are of U-shaped cross-section, a respective arm of each U-section extending in a respective longitudinal trough defined between a respective pair of said at least three shells.

10. A container according to claim 4, wherein each central shell element of the container is connected with a respective vertical tie element via a pressure sheet and a gusset.

* * * * *